US005285248A

United States Patent [19]

Menjo et al.

[11] Patent Number: 5,285,248

[45] Date of Patent: Feb. 8, 1994

[54] FIXING DEVICE HAVING SILICONE RUBBER SPRAYED WITH PHENYL TYPE SILICONE OIL

[75] Inventors: Takeshi Menjo, Tokyo; Masaaki Sakurai, Yokohama; Tatsuo Takeuchi, Kawasaki, all of Japan

[73] Assignee: Canon Kabushiki Kaisha, Tokyo, Japan

[21] Appl. No.: 619,402

[22] Filed: Nov. 29, 1990

[30] Foreign Application Priority Data

Nov. 29, 1989 [JP] Japan ..... 1-309960
Nov. 29, 1989 [JP] Japan ..... 1-309961

[51] Int. Cl.[5] ..... G03G 15/20

[52] U.S. Cl. ..... 355/284; 219/216; 430/99; 432/60

[58] Field of Search ..... 355/282, 284, 285; 118/60; 432/60; 219/216; 430/99

[56] References Cited

U.S. PATENT DOCUMENTS 4,125,362 11/1978 Matsui et al. ..... 432/60
4,272,179 6/1981 Seanor ..... 355/284
4,640,600 2/1987 Hirabayashi et al. ..... 219/216 X

*Primary Examiner*—Leo P. Picard
*Assistant Examiner*—Christopher Horgan
*Attorney, Agent, or Firm*—Fitzpatrick, Cella, Harper & Scinto

[57] ABSTRACT

This invention relates to a fixing device with a heat rotatory body heated by a heating source having a surface layer of a silicone rubber; a back-up rotatory body which is in pressure contact with the heated rotatory body; an oil feeding apparatus which feeds silicone oil to the heated rotatory surface; the pair of rotatory bodies performing fixing while conveying the supporting material having unfixed images supported thereon sandwiched therebetween; and the feeding oil being a phenyl type silicone oil and the silicone rubber surface being impregnated with dimethylsilicone oil.

13 Claims, 3 Drawing Sheets

FIXING DEVICE HAVING SILICONE RUBBER SPRAYED WITH PHENYL TYPE SILICONE OIL

BACKGROUND OF THE INVENTION

1. Field of the Invention

This invention relates to a fixing device which is used for an image forming device such as copying machine, printer, etc. which fixes unfixed images on a supporting material.

2. Related Background Art

As the fixing device for fixing unfixed images, there has been widely used a hot roller fixing device which uses a heating roller with a heater built therein and a back-up roller in pressure contact with the heating roller.

Such heating roller is of the type using a rubber layer as the release layer and of the type using a release layer, but it is advantageous to use a rubber layer for obtaining high fixability. As such rubber, silicone rubber is generally employed for elastic characteristics and mold releasability.

Also, for prevention of off-set, silicone oil is coated on the surface rubber layer. However, fixing by such an image fixing device has been found to generate the following inconveniences.

That is, silicone oil coated as the release agent on the silicone rubber layer of the fixing roller is transferred onto toner and transfer paper during fixing, thereby effecting fixing of the toner image T onto the transfer paper, but the silicone oil remains on the fixing roller in a considerable amount and will penetrate the silicone rubber with time.

The penetration of silicone oil into the silicone rubber layer is further promoted when the fixing roller is heated, rotated, and when the silicone rubber layer receives stress from the pressurizing roller by rotation.

The silicone oil penetrated into the silicone rubber layer promotes pyrolysis of HTV silicone rubber constituting the rubber layer by heat, pressure. If this state continues for a long time, the silicone rubber layer will undergo lowering in hardness as the result of progress of pyrolysis, and further the rubber layer is swelled with the silicone oil, until finally chemical bonding of the HTV silicone rubber is cleaved to effect scission of the rubber. As the result, there occurs the phenomenon that the silicone rubber layer is peeled off from the fixing roller.

Such phenomenon is liable to occur as the temperature is higher, particularly at the silicone rubber layer near the core metal made of aluminum. This may be considered because decomposition of the rubber proceeds greatly as the temperature is higher. For example, even if the thermal conductivity of the HTV rubber may be made as high as $1.0\times10^{-3}$ cal/cm·sec·deg, the temperature in the vicinity of the core metal which will vary depending on such conditions as outer air temperature, heat content of the heater, rotation of the roller, etc., may sometimes become 200° C. when the surface temperature is 170° C.

This is not limited to HTV silicone rubber, but the same phenomenon also occurs with RTV (room temperature vulcanizable type) rubber such as dimethylsilicone rubber or methylvinyl silicone rubber or LTV (low temperature vulcanizable type) silicone rubber.

The phenomenon as described above depends on the use time accompanied with heating of the image fixing device, but the time before generation does not differ greatly, although it may vary to some extent depending on the kind of the rubber constituting the silicone rubber layer, the viscosity of the silicone oil, its coated amount, or the heating time, pressurization conditions, rotational conditions of the fixing roller.

For prevention of silicone rubber with silicone oil, for example, Japanese Patent Publication No. 54-26373 proposes a combination of a silicone rubber and a silicone oil so that the rubber layer will not will swell only a or swelled little by selecting the kind of the silicone rubber constituting the rubber layer of the fixing roller, etc. and the kind of the silicone oil coated.

According to the above proposal, as the silicone oil, those of chloro type, fatty acid modified type, nitrile type or fluoro type are employed, and as the silicone rubber, those of methyl type, methylvinyl type or phenyl type are used. Alternatively, as the silicone oil, those of methyl type, phenyl type, methylhydrogen type, methylphenyl type, dimethylphenyl type, chloro type, fatty acid modified type, nitrile type or fluoro type are used, and as the silicone rubber, those of nitrile type or fluoro type are employed (however, when those of nitrile type or fluoro type are used as the silicone oil, silicone rubbers of the same type are excluded).

According to such combination of silicone oil and silicone rubber as mentioned above, it is stated that swelling of the silicone rubber constituting the rubber layer of the fixing roller, etc. with silicone oil can be prevented.

The following Table 1 is an extraction of a part of the combinations from the above proposal. According to this, when one of methyl type, methylvinyl type, and phenyl type is used as the silicone rubber, and one of methyl type, phenyl type is used as the silicone oil, swelling occurs in the rubber, and therefore such combination is stated to be undesirable.

TABLE 1

| | Silicone oil | |
|---|---|---|
| Rubber: | Methyl type | Phenyl type |
| Methyl type | x | x |
| Methylvinyl type | x | x |
| Phenyl type | x | x |

x: indicating that rubber is swelled

As observed from the aspect of mold releasability, methyl type or methylvinyl type or phenyl type silicone rubber is excellent as the rubber material.

In Japanese Patent Publication No. 54-26373, for methyl type, methylvinyl type silicone rubber, silicone oils of chloro type, fatty acid modified type, nitrile type or fluoro type are mentioned as silicone oils which are not swelled with oils, but these materials have lower heat resistance or can be prepared with difficulty to be expensive, and hence not suitable as the coating oil for heating fixing rollers.

As a coating for the heating fixing rollers, silicone oils of methyl type or phenyl type are suitable from the point of view of heat resistance and bulk productivity, but they are combinations which are swelled with methyl type, methylvinyl type, phenyl type silicone rubbers as described above.

SUMMARY OF THE INVENTION

An object of the present invention is to provide a fixing device by use of a heated rotatory body which is excellent in mold releasability and is not swelled with oil.

Another object of the present invention is to provide a fixing device which can coat a heated rotatory body covered on the surface with a methyl type or methylvinyl type silicone rubber with a phenyl type silicone oil.

Still another object of the present invention is to provide a fixing device with a phenyl type silicone oil coated one silicone rubber impregnated with dimethylsilicone oil.

Still another object of the present invention is to provide a fixing device by use of a heated rotatory body having a methyl type or methylvinyl type silicone rubber surface layer with a saturated swelling amount for methylphenyl type silicone oil of 0% or less.

Further objects of the present invention will be apparent from the following description.

DESCRIPTION OF THE PREFERRED EMBODIMENTS

Figure 1:
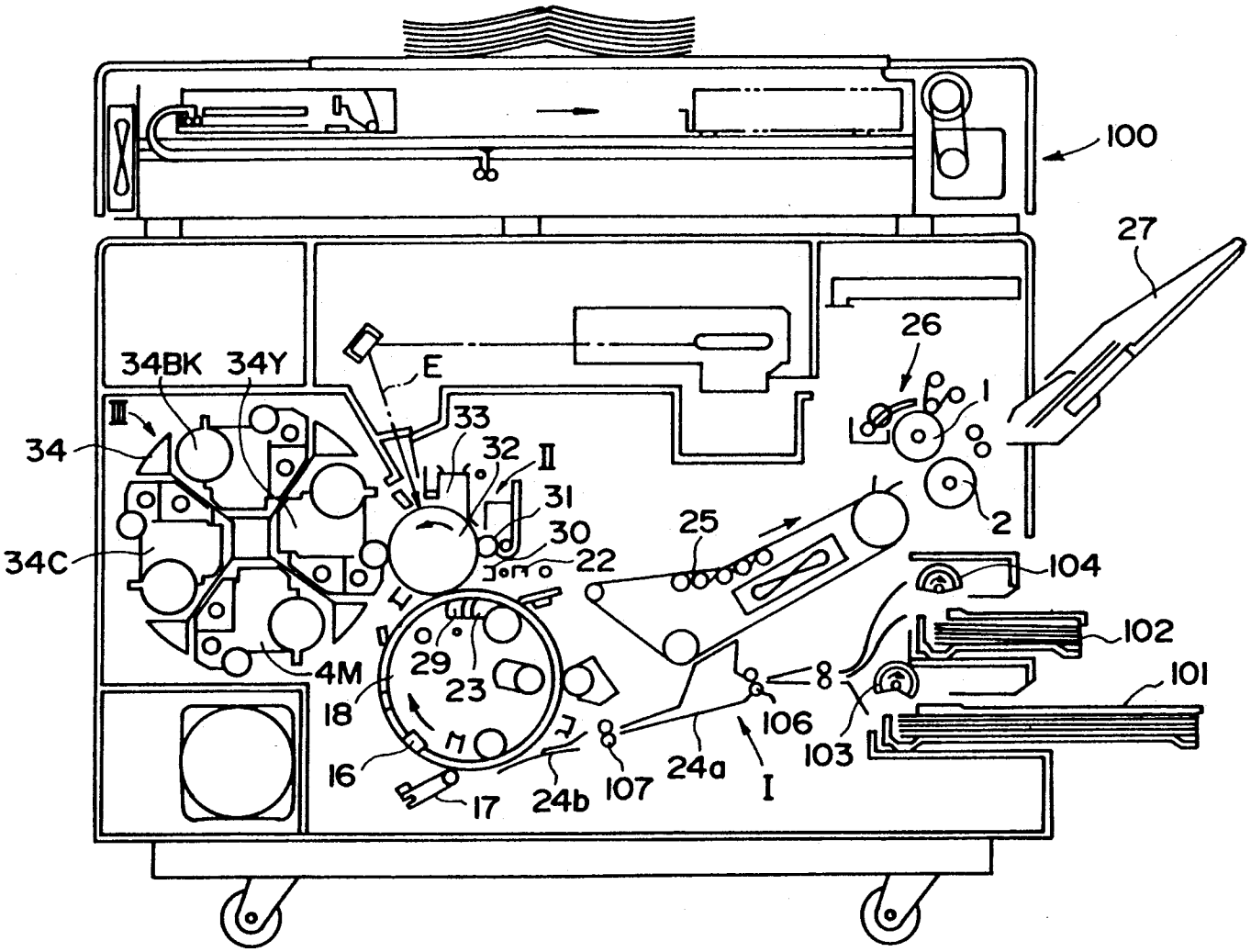
FIG. 1 is a constitutional illustration showing an embodiment of the image forming device equipped with the image fixing device of the present invention.

Referring now to the drawings, the embodiments of the present invention are described.

The inventors of present invention have found that, when a methyl type or methylvinyl type silicone rubber is used for constituting the fixing roller, and methylphenyl type silicone oil is used as the oil to be fed to the fixing roller, some of the combinations have a saturated swelling amount of silicone rubber for silicone oil of 0% or less, whereby no silicone oil will into penetrated into the silicone rubber and swelling of the rubber with the oil can be prevented.

In the following, on the basis of the experiments conducted by the present inventors, the present invention is described.

The present inventors have conducted the experiments to determine the saturated swelling amount of methylphenylsilicone oil with the silicone rubber constituting the fixing roller at 200° C.

Experiments

A methyl type or methylvinyl type silicone rubber was cured according to the method known in the art or the method recommended by the rubber manufacture, and each rubber strip of 2 mm in height, 20×10 mm was prepared, and these rubber strips were dipped as such in an oil bath in which methylphenyl silicone oil was heated to 200° C.

The methyl type silicone rubber or methylvinyl type silicone rubber employed is KE 1300, KE 1603 and KE 1406 manufactured by Shinetsu Kagaku K.K. The methylphenyl silicone oil employed is KF 54, 450 cs manufactured by Shinetsu Kagaku K.K.

The saturated swelling amount (%) of the silicone rubber for the silicone oil was determined from the initial weight A (g) of the rubber strip before dipping in the oil bath and weight B (g) after dipping according to the following formula:

$$(B-A)/A\times 100.$$

As the result, the saturated swelling amounts of the silicone rubber for the silicone oils were found to be as follows:

KE 1300: +20%
KE 1603: +15%
KE 1406: −3%.

According to the above results, as shown in Japanese Patent Publication No. 54-26373, when a methyl type or methylvinyl type silicone rubber is combined with a methylphenyl type silicone oil, rubber is swelled with the oil in some combinations, but the above results show that there are also other combinations in which the rubber is not swelled with the oil (rather reduced in weight according to the present experiments). Thus, it is difficult to say as a general rule that the rubber is swelled with the oil in combinations of methyl type and methylvinyl type silicone rubber with methylphenyl type silicone oil.

In the above results, reduction of weight of the silicone rubber of KE 1406 to −3% as compared with the initial stage occurs as the result of one or both of the phenomenon oozing of the oil or lower molecular weight components in the silicone rubber out of the rubber, and the heating weight reduction of the rubber by heating in the oil bath of 200° C.

As described above, there exist rubbers which swell with methylphenyl type silicone oils among methyl type, methylvinyl type silicone rubbers and those which are not swelled, and it has been found that whether the silicone rubber is swelled or not greatly depends on the crosslinking density of the rubber as one cause. That is, it has been found that by increasing the crosslinking density of the silicone rubber, swelling with methylphenyl silicon oil can be suppressed, and the saturated swelling amount can be controlled to from 20% or more to 0% or less as shown by the experiments.

As to other causes, there is the amount of the fillers in the silicone rubber, and the amount of fillers has also great influence. As the amount of the fillers is larger, the silicone oil is penetrated in less amount into the silicone rubber, whereby the saturated swelling amount of the rubber with the oil can be suppressed.

Further, in addition to the above-mentioned causes, the curing temperature and the curing time applied on the rubber in molding the silicone rubber into a fixing roller have also influences, and also the saturated swelling amount is controlled according to the curing conditions during rubber molding.

As described above, swelling can be prevented by controlling the crosslinking density of methyl type silicone rubber or methylvinyl silicon rubber and the filler amount in the silicone rubber, etc., thereby controlling the swelled amount of the silicon rubber with methylphenyl silicone oil.

However, as the condition of methylphenyl silicone oil, the number of moles of phenyl groups is one factor. More specifically, if the number of moles of phenyl groups in methylpheyl silicone oil is lower than 5 mole %, the swelling prevention effect of the rubber for methylphenyl silicone oil becomes smaller. This is because, if the moles of phenyl groups in methylphenyl silicone oil are lower than 5 mole %, the physical properties of methylphenyl silicone oil become substantially equal to dimethylsilicone oil, whereby methylphenyl silicone oil becomes readily penetrable into the rubber to reduce, the effect of making the rubber resistent to swelling. Accordingly, it is desirable that the moles of phenyl groups in the methylphenyl silicone oil should be 5 mole % or less.

The viscosity of the methylphenyl silicone oil at room temperature should be desirably 10 to 10000 cs.

Next, the image forming device equipped with the image fixing device of the present invention is to be described.

FIG. 1 is a constitutional illustration showing an embodiment of the electrophotographic image forming device capable of forming full-color images equipped with the image fixing device of the present invention.

The present image forming device, as shown in FIG. 1, is basically constituted of a transfer conveying system I provided over from one side of the main device 100 (right side in FIG. 1) to approximately the central portion of the main device 100, a latent image forming portion II provided approximate to the transfer drum 18 rotatable in the arrowhead direction which constitutes the transfer material conveying system I at approximately the central portion of the main device, and a developing means, namely the rotatory developing device III, arranged approximate to the latent image forming portion II on the other side of the main device 100.

The transfer conveying system I comprises trays 101, 102 for feeding transfer materials which are freely detachable relative to the opening formed on one side (right side in FIG. 1) of the main device 100, rollers for paper feeding 103, 104 arranged approximately directly above these trays 101, 102, a paper feeding guide 24*a* equipped on both ends thereof with paper feeding rollers 106, 107 arranged approximate to these rollers 103, 104 and a paper feeding guide 24*b* subsequent thereto, a roller 17 for transfer material contact, a gripper 16, a charger for transfer material separation 22 and a separation nail 20 provided around the transfer drum 18 in the rotational direction successively from its lower end to upper end, a transfer charger 19 and a charger for transfer material separation 23 arranged at the innerside of the transfer drum 18, a conveying belt means 25 provided approximate to said separation nail 20 above the paper feeding guide 24*a*, a tray for transfer material discharge 27 which is provided as extended outwardly from the main device 100 on the extension from the final end in the conveying direction of said means 25 and freely detachable from the main device 100, and the image fixing device 26 according to the present invention arranged between these conveying belt means 25 and tray for discharge 27.

The latent image forming section II is equipped with an image carrier rotatable in the arrowhead direction arranged on approximately the upper end of the transfer drum 18 in contact therewith, namely a drum 32, a charger for deelectrification 30 provided around said drum 32 in the rotational direction from the upper end to the side end, a cleaning means 31, a primary charger 33 and an image exposure means such as laser beam for forming electrostatic latent images on the outer peripheral surface of the photosensitive drum 32, and an image exposure reflection means such as polygonal mirror.

The rotatory developing device III has a rotatory body 34 comprising a freely rotatable case, an yellow developing instrument 34Y, a magenta developing instrument 34M, a cyan developing instrument 34C and a black developing instrument 34BK mounted on the rotatory body 34 and constituted so as to visualize, namely develop the electrostatic latent images at the position opposed to the outer peripheral surface of the photosensitive drum 32.

To describe about the sequence of the whole image forming device of the above constitution, it may be briefly described by referring to an example in the case of full mode as follows.

That is, when the photosensitive drum 32 rotates in the arrowhead direction shown in FIG. 1 and the photosensitive layer on the drum 32 is uniformly charged by the primary charger 33, exposure of the images is effected with the laser beam E modulated with the yellow image signal on the manuscript to form electrostatic latent images of yellow images on the photosensitive drum 32. The electrostatic latent images of yellow images are developed by the yellow developing instrument 34Y fixed previously at the developing position by rotation of the rotatory body 34 of the developing device III.

On the other hand, the transfer material (not shown) conveyed via the paper feeding guide 24*a*, the paper feeding roller 106, the paper feeding guide 24*b* is held by the gripper 16 at a predetermined timing and wound up around the transfer drum 18 electrostatically by the roller for contact 17 and the electrodes opposed thereto. The transfer drum 18 is rotating in the arrowhead direction shown in FIG. 1 as synchronized with the photosensitive drum 32, and the visible image developed by the yellow developing instrument 34Y is transferred by the transfer charger 19 at the site where the outer peripheral surface of the photosensitive drum 32 contacts the outer peripheral surface of the transfer drum 18. The transfer drum 18 continues rotation as such and stands by for transfer of the next color (magenta in FIG. 1).

On the other hand, the photosensitive drum 32 is deelectrified by the charger for deelectrification 30, cleaned by the cleaning means 31, and then charged again with the primary charger 33 to receive the image exposure as mentioned above from the magenta image signal. The developing device III rotates during formation of electrostatic latent images by the magnet image signal according to the above-mentioned image exposure on the photosensitive drum 32 to have the magenta developing instrument 34M positioned in place at the developing position and performs predetermined magenta developing thereat.

Subsequently, the above-described process is practiced also on cyan color and black color, respectively, and on completion of transfer corresponding to 4 colors, visible images of 4 colors formed on the transfer material are deelectrified by the respective chargers 22, 23, to release grip of the transfer material by the gripper 16. Simultaneously with this, said transfer material is separated from the transfer drum 18 by the separation nail 24, delivered by the conveying belt means 25 to the image fixing device 26, where color mixing and fixing are effected by heat and pressure, thereby completing the sequence of a series of full-color print to form the desired full-color print image.

Next, the developer to be used in the present image forming device is described.

The color toner of the developer to be used in the image forming device of color is required to have good meltability, color mixability when heat is applied, and it is preferable to use a toner with sharp meltability having a low softening point and a low melt viscosity. Thus, by use of a toner with such sharp meltability, the reproducing range of the copied product can be broadened to obtain a color copy faithful to the manuscript image.

Such sharp meltable toner can be prepared by, for example, melting and kneading a polyester resin, a styrene-acryl resin, a colorant (dye, sublimable dye), a charge controller, etc., pulverizing the kneaded product, followed by classification. If necessary, various external additives can be added in the toner.

In view of fixability, sharp meltability of the color toner, one obtained by use of a sharp meltable polyester resin as the binder resin is particularly preferable. Sharp meltable polyester resin is a polymeric compound having ester bond in the main chain of the molecule synthesized from a diol compound and a dicarboxylic acid. The sharp meltable color toner to be used in the present image forming device should preferably be one comprising a sharp meltable ester resin having a softening point of 60° to 150° C., preferably 80° to 120° C.

Figure 2:
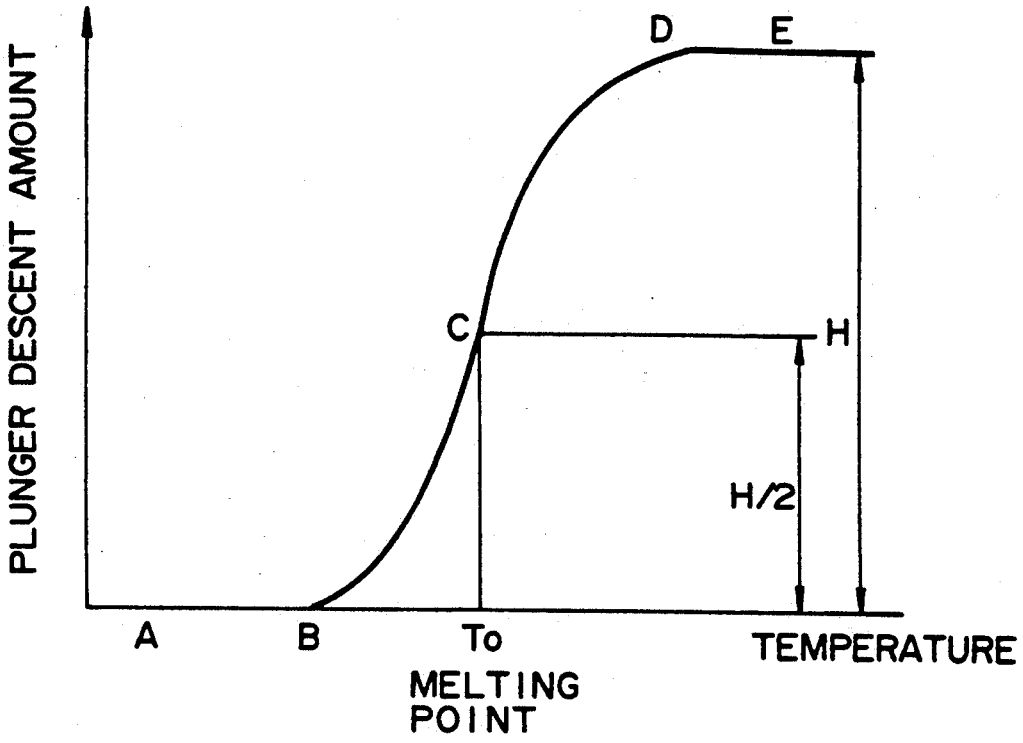
FIG. 2 is a graph showing the softening characteristics of a sharp meltable color toner to be used in the image forming device shown in FIG. 1.

The softening characteristics of such sharp meltable color toner are shown in FIG. 2.

FIG. 2 is the plunger descent amount-temperature curve (hereinafter called as "melting S-curve") of the toner determined by drawing when a flow tester CFT Model 500 (Shimazu Seisakusho) is used, a load of 50 kg is applied with a die (nozzle) of a diameter of 0.5 mm and a thickness of 1.0 mm, and the temperature is elevated at equal rate of 5° C./min. from the initial setting temperature of 80° C. after pre-heating for 300 seconds. As the color toner for the sample, 1 to 3 g of purified fine powder is employed, and as the plunger one having a sectional area of 1.0 $cm^2$ is employed.

The softening S-curve of the color toner becomes as shown in FIG. 2. More specifically, as the temperature is elevated at equal rate, the toner is gradually heated to commence flow-out (plunger descent A→B). When the temperature is further elevated, the toner under molten state will flow-out greatly (B→C→D), whereby plunger descent will stop (D→E).

The height of the S-curve indicates the total amount flowed out, and the temperature To corresponding to the C point of H/2 indicates the melting point of the toner.

Sharp meltable resin which gives such color toner refers to a resin satisfying the condition of $T_1=90°$ to 150° C., $|\Delta T|=|T_1=T_2|=5°$ to 30° C., wherein $T_1$ is the temperature when indicating a melt viscosity of $10^5$ cp and $T_2$ is the temperature when indicating $5\times10^4$ cp.

The sharp meltable resin having such temperature-melt viscosity characteristics as described above is characterized by undergoing viscosity lowering extremely sharply by heating. Such viscosity lowering gives rise to adequate mixing between the uppermost toner layer and the lowermost toner layer of the color toner layers, and further increases abruptly the transparency of the toner layer itself, thereby effecting good toner reduction mixing. The sharp meltable color toner by use of such resin has great affinity power and can be readily off-set onto the fixing roller.

Next, the image fixing device of the present invention is described.

Figure 3:
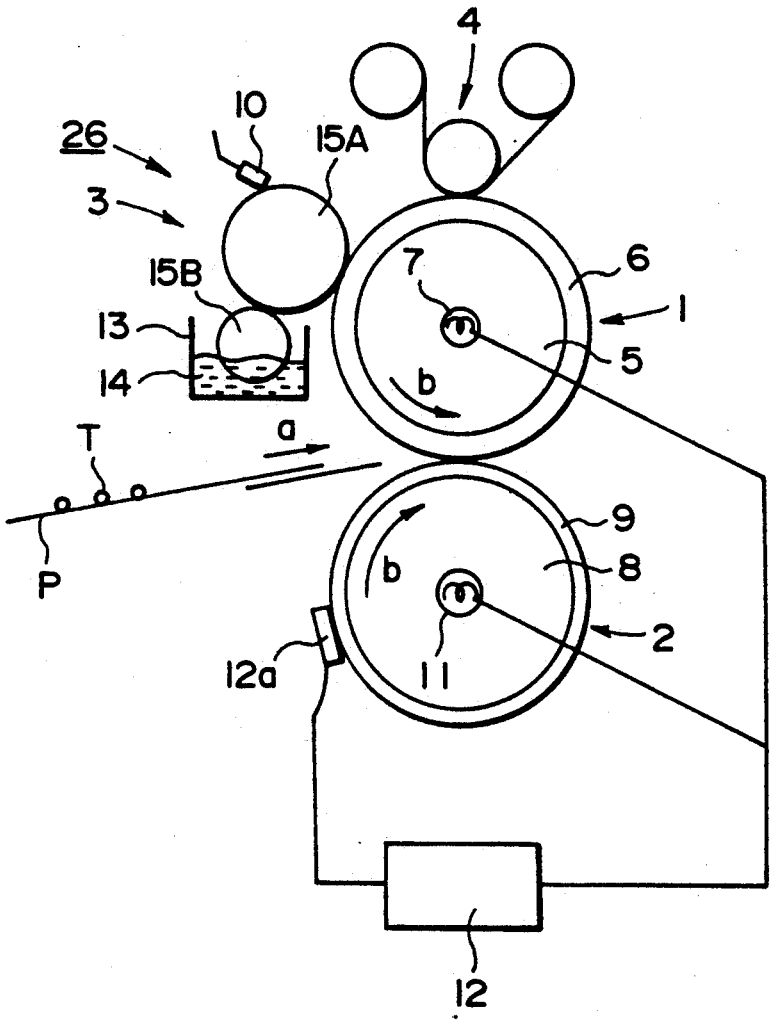
FIG. 3 is a schematic constitutional illustration showing an embodiment of the image fixing device of the present invention.

FIG. 3 is a schematic constitutional view showing an embodiment of the image fixing device of the present invention.

The present image fixing device 26, as shown in FIG. 3, comprises a fixing roller 1, a pressurizing roller 2 opposed thereto, a release agent coating means 3 for coating the fixing roller 1 with a silicone oil which is the release agent, and a cleaning means 4 for cleaning the fixing roller 1 equipped therein.

The fixing roller 1 comprises a core metal 5 made of aluminum coated with a silicone rubber layer 6 as described below thereon, and its outer diameter is made 40 mmϕ.

The pressurizing roller 2 comprises a core metal 8 coated with an HTV (high temperature vulcanizable type) silicone rubber with a thickness of 1 mm thereon, and a fluorine resin layer 10 formed on its surface, and similarly its outer diameter is made 40 mmϕ.

Within the core metal 5 of the fixing roller 1 and the core metal 8 of the pressurizing roller 2, halogen heaters 7, 11 which are heating sources are arranged, the temperature of the pressurizing roller 2 is detected with the thermistor **12*a* in contact therewith, and on-off controls of the halogen heaters 7, 11 are performed by the temperature control device 12, whereby the temperatures of the fixing roller 1 and the pressurizing roller 2** are maintained constantly at about 170° C.

The release coating means 3 is devised to scoop up a methylphenyl silicon oil with a viscosity of 450 CS (Shinetsu Kagaku K.K., KF 54, 450 cs) as the silicone oil 14 housed in the vessel 13 by the upper and lower feeding rollers 15A, 15B, and coating silicone rubber layer 6 of the fixing roller 1 with the oil. The amount of the silicone oil coated onto the rubber layer 6 is controlled by the coated amount controlling blade 10 in contact with the upper feeding roller 15A.

The cleaning means 4 removes the toner off-set onto the silicone rubber layer 6 of the fixing roller 1.

The transfer paper P having the unfixed toner image T is conveyed by the conveying device (not shown) in the direction of the arrowhead a, and the transfer paper P is passed by the driving device (not shown) in the arrowhead direction a while being sandwiched between the fixing roller 1 and the pressurizing roller 2, whereby the toner is melted with the heat and the pressure between the rollers 1, 2 to have the toner image T fixed on the transfer paper P.

According to this embodiment, the fixing roller 1 comprises a rubber layer 6 by use of a dimethylsilicone rubber with a saturated swelling amount of −3% (Shinetsu Kagaku K.K., KE 1406) so that the rubber may not be swelled with methylphenyl silicone oil.

Ordinarily, when a color toner image is to be fixed, the rubber layer 6 of the fixing roller 1 must be coated with a large amount of silicone oil as the release agent, but in this embodiment, 0.08 g of methylphenyl silicone oil calculated per one sheet of A4 transfer paper as measured by the oil coated amount measuring method as described below is coated.

When fixing of the toner image was carried out by means of the image fixing device 26 under the conditions as described above, even when the fixing roller 1 may be used under heating for one year, no swelling of the silicone rubber layer 6 with silicone oil or rubber breaking of the rubber layer 6 occurred to give good results.

Thus, in the present invention, a methyl type or methylvinyl type silicone rubber as the silicone rubber constituting the rubber layer 6 and a methylphenyl type silicone oil as the release agent coated on the rubber layer 6 are selected and combined so that the saturated swelling amount of the silicone oil in the silicone rubber layer 6 of the fixing roller 1 may be 0% or less. By doing so, the release effect with the methylphenyl type silicone oil of the release agent and the release effect from the rubber inner surface with the low molecular weight components of the rubber oozed out from in the rubber can be obtained to make the fixing roller 1 higher in life and higher in releasability. Also, because no silicone oil is penetrated into the rubber, it becomes possible that no deformation by swelling of the fixing roller 1 and no pyrolysis, destruction of the rubber by heating from the innerside will occur.

When a silicone rubber with a saturated swelling amount of 20% with dimethyl silicone rubber or methylphenyl silicone rubber (Shinetsu Kagaku K.K., KE 1300) is used, by use of the fixing roller under heating, oil swelling of the rubber occurs within 2 months, thereby causing lowering of hardness and also destruction of the rubber with heat to result in peel-off of the rubber from the core metal.

Similarly, when a rubber with a saturated swelling amount of 15% (Shinetsu Kagaku K.K., K 1603) is used, by use of the fixing roller under heating for 6 months, similar rubber destruction is consequently resulted.

As is apparent from the above description, the present invention is suitable for an image fixing device which coats the fixing roller with a silicone oil for obtaining releasability, particularly a full-color image forming device which is coated with a large amount of the oil.

In the foregoing embodiment, the case of a coated amount of the silicone oil onto the fixing roller 1 of 0.08 g/A4 as calculated per one sheet of transfer paper A4 was shown, but the coated amount may be effectively 0.001 g/A4 or more.

The amount of the silicone oil coated is determined as described below.

That is, the weight of 50 sheets of white paper with A4 size is defined as $A_1$ (g), and the weight of 50 sheets of the white paper after passage between the fixing roller and the pressurizing roller without transfer of images onto the white papers and also without coating of the silicone oil onto the rubber layer of the fixing roller is defined as B (g). Similarly, the weight of 50 sheets of another white paper with A4 size is defined as $A_2$ (g), and the weight of the white paper after passage between the fixing roller and the pressurizing roller without transfer of images onto the white paper, but coated with the silicone oil onto the rubber layer of the fixing roller is defined as C (g). Then, the amount X (g) of the silicone oil coated per one sheet of white paper with A4 size can be determined as follows:

$$X=(C+A_1-B-A_2)/50$$

In the present invention, the silicone rubber constituting the rubber layer 6 of the fixing roller 1 may be either the methyl type or the methylvinyl type to have the effect, but among them, particularly a methyl type RTV (room temperature vulcanizable type) silicone rubber with high releasability is preferable. This is because, although peelability from the toner image can be also obtained by coating of methylphenyl silicone oil with other silicone rubbers than RTV, in view of the off-set phenomenon wherein the toner is transferred during fixing onto the fixing roller, methyl type RTV silicone rubber is preferable in that the use life of the fixing roller until off-set can be elongated.

Similarly, in view of swelling resistance to methylphenyl silicone oil, methyl RTV silicone rubber of the condensation type is more preferable for higher resistance than methyl type RTV silicone rubber of the addition type. Although this is not sure, it may be considered that the crosslinking structure of the condensation type is:

$$\sim Si-O-Si\sim$$

as different from the crosslinking structure of the addition type:

$$\sim Si-CH_2-CH_2-Si\sim,$$

and due to such difference in crosslinking structure, difference occurs in mutual interaction with methylphenyl silicone oil, whereby swelling resistance to silicone oil of the condensation type may be higher.

Next, another embodiment of the present invention is described.

In the embodiment as described above, as the silicone rubber, one with a saturated swelling amount of 0% or less was employed, but the present inventors have also found that by use of a methyl type or methylvinyl type one as the silicone rubber constituting the fixing roller and a phenyl type one as the silicone oil to be coated on the fixing roller, and by incorporating previously dimethyl silicone oil in the rubber, substantially no silicone oil will be penetrated into the rubber, whereby swelling of the rubber with the oil can be prevented.

In the following, the embodiment is described on the bases of the experiments conducted by the present inventors.

Experiments

Methyl type and methylvinyl type silicone rubbers were cured according to the method known in the art or the method recommended by the manufacturer, rubber strips each of 2 mm in height and 20×10 mm were prepared, and these rubber strips were dipped as such in an oil bath in which methylphenyl silicone oil was heated to 200° C.

On the other hand, before dipping of the rubber strips in the above-mentioned oil bath, they were dipped once in an oil bath in which dimethyl silicone oil was heated to 200° C. for 8 hours to have dimethyl silicone oil impregnated into the rubber strips to prepare rubber strips of the oil-impregnated type, end thereafter the rubber strips were dipped in the same methylphenyl silicone oil bath as mentioned above.

All of the rubber strips with or without oil impregnation as described above were subjected to measurement of saturated swelling amount with methylphenyl silicone oil.

The rubber employed was SH9551 manufactured by Toray K.K. as the methyl type silicone rubber, and TSE 3453 as the methylvinyl type silicone rubber. For the dimethyl silicone oil, KF96 100 cs manufactured by Shinetsu Kagaku K.K. was employed, and for the methylphenyl silicone oil, KF54 450 cs manufactured by Shinetsu Kagaku K.K.

Both rubber strips comprising SH9551 and TSE 3453 were impregnated with about 20% by weight gain by dipping into the dimethylsilicone oil.

The measurement results of the saturated swelling amount in the rubber strips with and without oil impregnation were found to be as follows.

SH9551 (no oil impregnation): +10%
SH9551 (with oil impregnation): −10%
TSE3453 (no oil impregnation): +15%
TSE3453 (with oil impregnation): −15%.

As described above, both methyl type (SH9551) and methylvinyl type (TES3453) silicone rubbers can become rubbers non-swellable with methylphenyl silicone oil from swellable rubbers by previous impregnation with dimethyl silicone oil.

One of the reasons is that previous impregnation can permit dimethyl silicone oil already introduced into the silicone rubber to play a role of the barrier against phenyl silicone oil which will enter the rubber from outside, thereby impeding entering of phenyl silicone oil into the rubber, with its effect being very great.

Also, because the dimethyl silicone oil previously impregnated in the silicone rubber, the molecular weight components in the oil and the low molecular weight components in the rubber are oozed out to reduce the weight of the rubber, and/or the rubber is reduced in weight by heating, it may be considered that there becomes no swelling of the rubber by penetration of the phenyl silicone oil.

In the prior art, it has been accepted that methyl silicone oil and methylphenyl silicone oil are incompatible if the moles of phenyl groups in methylphenyl silicone oil exceed 15%, but in the present invention, it is not merely incompatibility that is utilized, but a new effect is created that no methylphenyl silicone oil will be penetrated into the rubber by permitting dimethyl silicone oil in dimethyl silicone rubber and this is utilized.

In other words, if it is merely compatibility that is used it may be only considered that while methylphenyl silicone oil is penetrated into the rubber, this is not mixed with the dimethyl silicone oil in the rubber. However, as described above, in the present embodiment, no swelling of the rubber with methylphenyl silicon oil occurs, but an effect as the oil barrier is obtained, and in this point, a phenomenon greatly different from the prior art is utilized.

As described above, by having previously dimethyl silicone oil impregnated in the silicone rubber, swelling of the rubber with methylphenyl silicone oil can be controlled to avoid swelling of the rubber.

Also, in the present embodiment, as the condition of the methylphenyl silicone oil, the number of moles of phenyl groups is one factor. More specifically, if the moles of phenyl groups in the methylphenyl silicone oil are lower than 5 mole %, the swelling prevention effect of the rubber with methylphenyl silicone oil by previous impregnation of dimethyl silicone becomes smaller. This is because, if the moles of phenyl groups in the methylphenyl silicone oil are lower than 5 mole %, the physical properties of the methylphenyl silicone oil become substantially equal to those of dimethyl silicone oil, whereby the methylphenyl silicone oil will be readily penetrated into the rubber to reduce the effect of swelling resistance of the rubber.

Therefore, similarly as in the embodiment as described above, the moles of phenyl groups in the methylphenyl silicone oil should be desirably 5 mole % or more.

The viscosity at room temperature of the methylphenyl silicone oil which is the coating oil may be preferably 10 to 10000 cs.

On the other hand, the viscosity at room temperature of the dimethyl silicone oil to be previously impregnated may be preferably 10 to 1000 cs, particularly 50 to 1000 cs, because it can be more readily penetrated adequately into the rubber as the viscosity is lower.

More preferably, the viscosity of the dimethyl silicone oil previously impregnated into the silicone rubber should be preferably made lower than the viscosity of the methylphenyl silicone oil externally supplied and coated. This is because, if the viscosity of the dimethyl silicone oil previously impregnated into the silicone rubber is made lower than that of the methylphenyl silicone oil, the action of oozing out the dimethyl silicone rubber externally of the rubber as mentioned above is promoted. By this, the release and barrier effects with the dimethyl silicone oil from internally of the silicone rubber is promoted.

In the above description, by dipping a silicone rubber in a dimethyl silicone rubber, the dimethyl silicone was externally added and impregnated into the rubber to be incorporated therein. As an alternative method, a dimethyl silicone oil could be internally added during formulation of a silicone rubber, whereby similar effects were obtained.

More specifically, by use of a dimethyl silicone rubber (Toshiba K.K., SH9551), during kneading of its formulation, about 5% of a dimethyl silicone oil (Shinetsu Kagaku K.K., KF96, 100 cs) was mixed, internally added to be incorporated therein, and the rubber obtained was cured and molded into a fixing roller. The fixing roller was used under heating while feeding a methylphenyl silicone oil to the fixing roller, the methylphenyl silicone oil was never penetrated into the rubber, and good results could be obtained without occurrence of swelling of the rubber, and without occurrence of pyrolysis, peel-off from the core metal of the rubber.

As described above, the dimethyl silicone oil may be either incorporated by external addition, impregnation after rubber molding, or internally added during formulation of the rubber.

The amount of the dimethyl silicone oil incorporated in the rubber can be 1% or more based on the rubber weight to give the effects of the present invention. However, if too much amount of a dimethyl silicone oil is incorporated by external addition or internal addition, the physical properties, strength of the rubber itself will be lowered, and therefore an amount of 1 to 50% is preferable for the purpose of using it as the fixing roller.

The silicone rubber to be used as the fixing roller should be preferably one having a high crosslinking density. This is because, although there is sufficient barrier effect against phenyl silicone oil by the dimethyl silicone oil existing in the silicone oil, for inhibiting further penetration of phenyl silicone oil into the rubber the crosslinking density of the rubber should be preferably higher. More preferably, the same effect as mentioned above can be increased as the amount of the fillers in the silicone rubber is increased. However, if the amount of the fillers is too great, releasability of the fixing roller will be lowered, and therefore it should be determined suitably with good balance between the releasability and the swelling degree of the rubber.

Next, an embodiment in which the silicone rubber impregnated with the dimethyl silicone oil is used in the device shown in FIG. 1 and FIG. 3 is described.

The fixing roller 1 was prepared by use of a dimethyl silicone rubber (Toray K.K., SH9551) as the rubber layer 6, curing it as the rubber roller, dipping the roller in an oil bath of 200° C. of a dimethyl silicone oil (Shinetsu Kagaku K.K., KF96, 100 cs) to impregnate and incorporate previously the dimethyl silicone oil into the rubber. By incorporation of the oil into the rubber, a weight gain of several % was recognized in the fixing roller 1.

Ordinarily, in the case of fixing color toner images, a large amount of a silicone oil as the release agent must be coated on the rubber layer 6 of the fixing roller 1, in this embodiment, 0.08 g of the methylphenyl silicone oil is coated as calculated per one A4 sheet of the transfer paper as measured by the oil coated amount measuring method as described below.

When fixing of the toner images was performed by the image fixing device 26 under the conditions as described above, even when the fixing roller 1 may be employed under heating for one year, good results could be obtained without occurrence of swelling of the silicone rubber layer 8 with the silicone oil, rubber destruction of the rubber layer 6, etc.

Thus, in this embodiment, by selecting a methyl type or methylvinyl type silicone rubber as the silicone rubber constituting the rubber layer 6, a phenyl type silicone oil as the silicone oil of the release agent to be coated on the rubber layer 6, and also incorporating previously a dimethyl silicone oil in the rubber, the release effect by the phenyl type silicone oil of the release agent and the release effect from internally of the rubber by the dimethyl silicone oil or its low molecular weight components oozed out from in the rubber can be obtained, whereby the fixing roller 1 can be made to have higher life and high releasability.

Also, because no silicone oil penetrates into the rubber, it is possible to prevent deformation by swelling of the fixing roller 1 and pyrolysis, i.e. the destruction of the rubber by heating from the innerside.

In the present embodiment, the case of making the amount of the silicone oil coated onto the fixing roller 1, 0.08 g/A4 as calculated per one A4 sheet of the transfer paper is shown, but an amount of 0.001 g/A4 or more is very effective.

In the embodiment as described above, description has been made by referring to the fixing roller with one layer of the silicone rubber, but it is also possible to use a fixing roller with a plurality of layers.

Having described above about the embodiments of the present invention, the present invention is not restricted by the embodiments as described above, but all of the modifications within the technical thought can be done.

What is claimed is:

1. A fixing device comprising:

a heat rotatable member having a surface layer comprising a silicone rubber;

a heating source for heating said heat rotatable member; and oil application means for applying silicone oil onto a surface of said heat rotatable member;

wherein said silicone oil is phenyl silicone oil and the silicone rubber is impregnated with a dimethylsilicone oil.

2. A fixing device according to claim 1, wherein said surface layer is methyl type or methylvinyl type silicone rubber.

3. A fixing device according to claim 2, wherein said silicone oil is methylphenyl silicone oil.

4. A fixing device according to claim 3, wherein moles of said methylphenyl silicone oil are 5 mole % or more.

5. A fixing device according to claim 1, wherein the viscosity of said silicone oil is 10 to 10000 cs.

6. A fixing device according to claim 1, wherein the viscosity of said impregnated oil is 10 to 1000 cs.

7. A fixing device according to claim 1, wherein the viscosity of said impregnated oil is lower than that of said silicone oil.

8. A fixing device according to claim 1, wherein the amount of said dimethylsilicone oil impregnated is 1 to 50% by weight of said silicone rubber.

9. A fixing device according to claim 1, wherein said fixing is used for a full-color image forming device which laminates toner images with different colors on a supporting material, and said fixing device mixes colors of the toner images of multiple layers.

10. A fixing device comprising:

a heat rotatable member having a surface layer comprising a silicone rubber;

a heating source for heating said heat rotatable member; and oil application means for applying a silicone oil onto a surface of said heat rotatable member;

wherein the silicone oil is a phenyl silicone oil, and the silicone rubber is a methyl type or methylvinyl type silicone rubber with a saturated swelling amount of 0% or less based on the phenyl silicone oil.

11. A fixing device according to claim 10, wherein moles of said methylphenyl silicone oil are 5 mole % or more.

12. A fixing device according to claim 10, wherein the viscosity of said silicone oil is 10 to 10000 cs.

13. A fixing device according to claim 10, wherein said fixing is used for a full-color image forming device which laminates toner images with different colors on a supporting material, and said fixing device mixes colors of the toner images of multiple layers.

* * * * *

UNITED STATES PATENT AND TRADEMARK OFFICE

CERTIFICATE OF CORRECTION

PATENT NO. : 5,285,248
DATED : February 8, 1994
INVENTOR(S) : TAKESHI MEJO, ET AL.

It is certified that error appears in the above-indentified patent and that said Letters Patent is hereby corrected as shown below:

Column 1,
Line 63, "vulcanizabIe" should red --vulcanizable--.

Column 2,
Line 9, "will" (2nd occurrence) should be deleted, and "only" should be deleted;
Line 10, "a or swelled" should read --or will swell only a--; and
Line 34, "phenyl" should read --and phenyl--.

Column 3,
Line 8, "one" should read --on a--;
Line 33, "of" should read --of the--; and
Line 39, "into penetrated into" should read --penetrate--.

UNITED STATES PATENT AND TRADEMARK OFFICE

CERTIFICATE OF CORRECTION

PATENT NO. : 5,285,248

DATED : February 8, 1994

INVENTOR(S) : TAKESHI MEJO, ET AL.

It is certified that error appears in the above-indentified patent and that said Letters Patent is hereby corrected as shown below:

Column 7,
Line 22, "called as" should be deleted; and
Line 45, "$|T_1 = T_2|$" should read --$|T_1 - T_2|$--.

Column 10,
Line 28, "bases" should read --basis--; and
Line 44, "end" should read --and--.

Column 11,
Line 2, "(TES 3453)" should read --(TSE 3453)--.

Column 14,
Line 5, "is" should read --is a--.

Signed and Sealed this

Thirteenth Day of September, 1994

*Attest:*

*Attesting Officer*

BRUCE LEHMAN

*Commissioner of Patents and Trademarks*